US010993585B2

(12) United States Patent
Tucker

(10) Patent No.: US 10,993,585 B2
(45) Date of Patent: May 4, 2021

(54) SYSTEM, METHOD AND APPARATUS FOR PROVIDING STEAM CIRCULATION AND CLEANING WITHIN A SHOWER ENCLOSURE

(71) Applicant: Ronald Tucker, Lincoln, NE (US)

(72) Inventor: Ronald Tucker, Lincoln, NE (US)

(73) Assignee: Ronald Tucker, Lincoln, NE (US)

( * ) Notice: Subject to any disclaimer, the term of this patent is extended or adjusted under 35 U.S.C. 154(b) by 0 days.

(21) Appl. No.: 16/369,762

(22) Filed: Mar. 29, 2019

(65) Prior Publication Data

US 2019/0223664 A1 Jul. 25, 2019

Related U.S. Application Data

(63) Continuation-in-part of application No. 15/411,764, filed on Jan. 20, 2017, now abandoned.

(60) Provisional application No. 62/286,022, filed on Jan. 22, 2016.

(51) Int. Cl.
*A47K 3/28* (2006.01)
*E03C 1/04* (2006.01)

(52) U.S. Cl.
CPC ..... *A47K 3/281* (2013.01); *E03C 1/04* (2013.01)

(58) Field of Classification Search
CPC ..... A47K 3/281; F24F 13/06; F24F 7/06
USPC ..... 4/596, 597
See application file for complete search history.

(56) References Cited

U.S. PATENT DOCUMENTS 3,878,621 A * 4/1975 Duerre ..... A45D 20/16 34/90
6,962,005 B1 * 11/2005 Khosropour ..... A47K 10/48 34/218
8,713,814 B2 5/2014 Martin
2008/0289099 A1 * 11/2008 Skinner ..... A47K 4/00 4/664

* cited by examiner

*Primary Examiner* — Christine J Skubinna
(74) *Attorney, Agent, or Firm* — Milligan PC LLO

(57) ABSTRACT

The present invention discloses a shower drying system and a system to provide air circulation within a pocket door assembly. According to one aspect of the present invention, a first preferred embodiment is provided which includes a shower to steam room conversion system in which activation of an internal control button/timer switch activates a blower which sends a layer of air through a web of plastic tubing fitted around a stainless-steel pocket door insert. Using this embodiment, air is forced through the tubing and directed to drive the water/moisture off the glass, all surfaces of the stainless pocket, and all surfaces of the shower interior and towards the drain of the shower making a clean, dry environment.

9 Claims, 8 Drawing Sheets

SYSTEM, METHOD AND APPARATUS FOR PROVIDING STEAM CIRCULATION AND CLEANING WITHIN A SHOWER ENCLOSURE

RELATED APPLICATIONS

The present application is a continuation-in-part of U.S. patent application Ser. No. 15/411,764 filed Jan. 20, 2017, which claims priority to U.S. Provisional Application No. 62/286,022 filed Jan. 22, 2016.

FIELD OF INVENTION

The present invention is related in general to a shower drying system and, in particular, to a system and method for providing air circulation and cleaning within a shower enclosure.

BACKGROUND OF THE INVENTION

Standard walk-in showers generally produce an excess of humidity and residual moisture. In normal use, the humidity and moisture within the shower enclosure will dissipate over a period of time once the water is shut off. During this time, the moisture is a nuisance which is protected against with sealants, drains and other protective surfaces which must be cleaned to prevent mildew, mold, staining and other detrimental effects of the residual moisture.

While removing moisture is an issue in traditional showers, steam showers actively produce and trap moisture in the form of steam. Once installed, the steam showers allow users to enjoy the warm, moist air created by the shower. A key drawback to these steam shower systems, however, is that they are not compatible with the shower systems present in most homes. Accordingly, to have a steam shower, either the steam shower enclosure must be built into the home from the start or a self-contained, shower enclosure must be specially installed at great expense.

What is needed is a system which removes the excess humidity and moisture of a conventional, residential shower while at the same time providing the heating and circulating benefits of a steam shower.

SUMMARY OF THE DISCLOSURE

To minimize the limitations found in the prior art and other limitations that will be apparent upon the reading of the specification, the preferred embodiment of the present invention provides a shower to steam room conversion system in which activation of an internal control button/timer switch activates a blower which sends a layer of air through a web of plastic tubing fitted around a stainless-steel pocket door insert. According to a preferred embodiment, the layer of warm air is preferably directed to heat the wet/steamy glass pocket door while at the same time providing a circulation of warm, moist air in a standard shower stall.

An important advantage of the present invention is that it dries and cleans the shower glass and the interior walls at the touch of button leaving a dry, clean environment. This results in surprising and significant benefits in saving the time to continually clean shower glass and it improves the hygiene of the entire shower enclosure by removing unwanted moisture.

According to another preferred embodiment of the present invention, the present invention further includes a clear pocket shower door enclosed within a stainless-steel enclosure with a rail mounting system to receive the pocket door. According to a further preferred embodiment, a curved notch is preferably cut into the front edge of the glass door to act as a pull.

According to a further preferred embodiment of the present invention, the shower to steam room conversion system of the present invention preferably provides a method of using air to push water out of the pocket enclosure and into a drainage system that leads to the drain of the shower, thus cleaning the glass door and drying the surfaces of the shower such that using a squeegee or other method for drying the shower is eliminated.

According to a further preferred embodiment of the present invention, the system of the present invention preferably further includes a manifold system which can be used in a variety of shower enclosures. Preferably, the system of the present invention further includes a system of tubing, manifold nipples, and nozzles which are preferably designed and positioned to maximize the driving of water off the walls/benches and down towards the drain of a shower enclosure. According to further preferred aspects of the present invention, the nozzles are preferably both adjustable and steerable. Further in accordance with the preferred embodiment, the locations of the nozzles within the enclosure may preferably be varied according to the size and shape of the shower enclosure to provide multiple levels of air streaming into the shower enclosure from the blower manifold. In accordance with further preferred embodiments, the system of the present invention may further include a number of air holes within the shower door enclosure and/or shower walls to allow a flow of air. In accordance with further preferred embodiments, the air holes may be used in combination with air nozzles or in place of air nozzles.

According to a further preferred embodiment of the present invention, an easy access control button/timer switch mechanism is provided to allow control of the system either near or within the shower enclosure. According to a preferred embodiment, when in use the system preferably uses directed air to force water down from the shower walls and into the drain of the shower. Additionally, the shower to steam room conversion system according to this preferred embodiment also serves to clean the shower and solve moisture issues.

According to a further preferred embodiment of the present invention, the door of the shower enclosure is preferably a sliding glass door which is fitted to slide into a stainless-steel welded pocket. According to further preferred embodiments of the present invention, the stainless-steel pocket preferably includes a series barbed male adapters welded to spine of pocket which are connected to the air delivery system via tubing. Preferably, at least eight barbed male adapters may be spread evenly down the back of the spine of the stainless-steel welded pocket. Further, the vinyl tubing may preferably be secured with metal compensating spring clamps or the like. Using the connected tubing system, air is preferably directed to the glass door which acts to remove water from the glass and from the pocket. Additionally, the friction of the air movement also produces warm air, which aids in the process of heating and distributing moist warm air as well. As designed, the system of the present invention can be used in any shower or steam room application. A preferred function of the invented system is to dry a shower/steam room door and/or any surrounding enclosures. A key advantage of the present invention is that at the push of a button, the shower enclosure and door can be made dry and mostly spot free.

According to a further preferred embodiment of the present invention, the air delivery system may be further integrated into existing shower walls. According to this aspect of the present invention, tubing from the manifold is preferably connected to one or more directional nozzles which are installed into the existing shower walls. Preferably, the nozzles may be near or at the top of the shower walls and directed down so that the wet walls may be dried as the air moves down to the drain.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and to improve the understanding of the various elements and embodiments of the invention. Furthermore, elements that are known to be common and well understood to those in the industry are not depicted in order to provide a clear view of the various embodiments of the invention. Thus, it should be understood that the drawings are generalized in form in the interest of clarity and conciseness.

DETAILED DESCRIPTION OF THE DRAWINGS

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
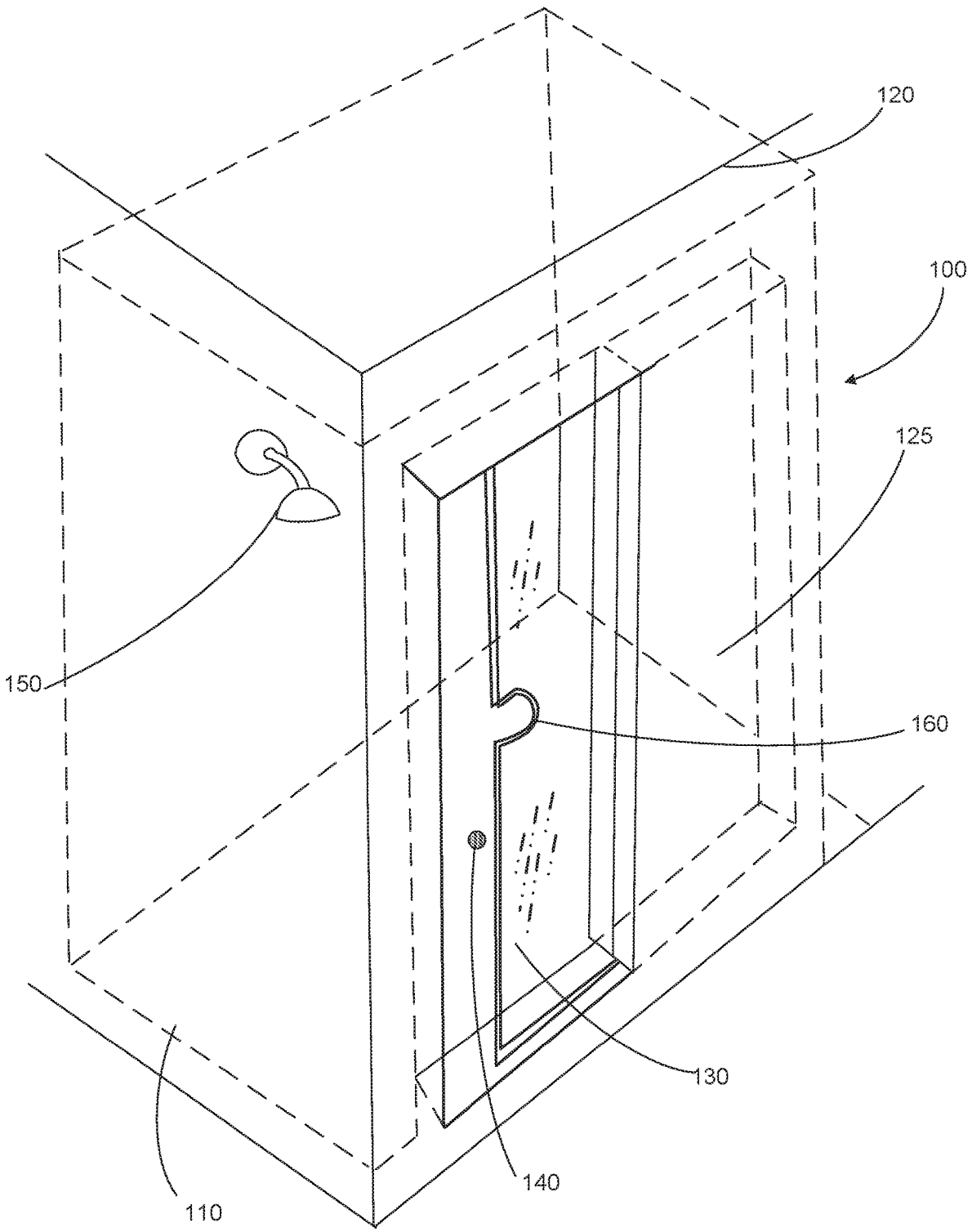
FIG. 1 is a side perspective view of a preferred embodiment of a shower to steam room conversion system of the present invention.

With reference now to FIG. 1, a first preferred embodiment of the present invention will now be discussed. As shown in FIG. 1, the system of the present invention is preferably designed for use with a standard shower unit 100 built into a wall structure of a home 120. As further shown in FIG. 1, the standard shower unit 100 is shown including a floor drain 140 within a sloped floor 110 and a standard shower head 150. As further shown in FIG. 1, a pocket door 130 is provided which is positioned to move in and out of a pocket enclosure 125. As further shown, the pocket door 130 is preferably made of a clear material such as tempered glass and formed with a notched door pull 160 at the center of the front edge of the glass pocket door 130.

Figure 2:
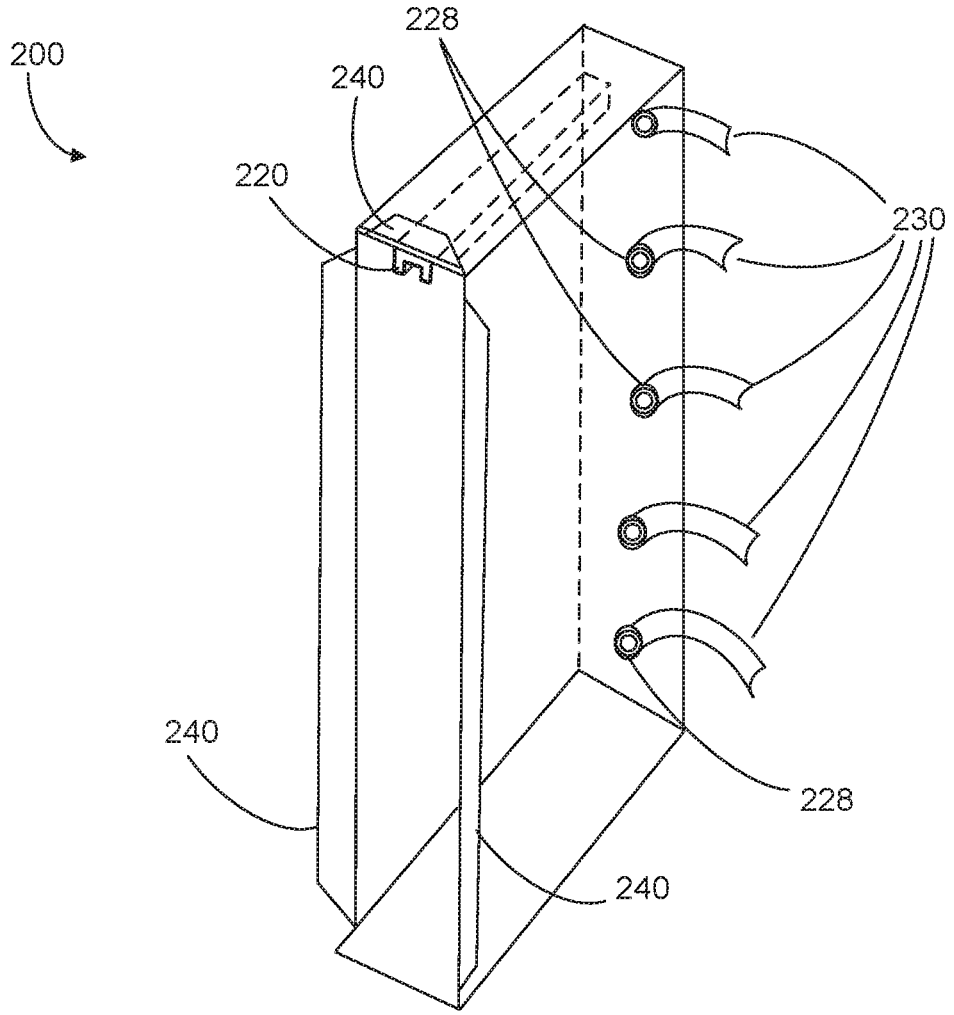
FIG. 2 is a first perspective view of an exemplary stainless-steel pocket door insert fitted with barbed tubing in accordance with a preferred embodiment of the present invention.

With reference now to FIG. 2, a perspective view of a pocket door insert fitted with barbed tubing of the present invention will now be discussed. As shown in FIG. 2, a pocket enclosure 200 is preferably formed to fit within a wall enclosure. According to a preferred embodiment, the pocket enclosure 200 is preferably formed from stainless-steel and fitted with a rail 220 for receiving and allowing the sliding of a sliding glass door (not shown). As further shown, preferably a series of barbed male adapters 228 are located within the back wall of the pocket and connected to a tubing system 230. Preferably, the tubing system includes one or more clear, vinyl tubes which are connected to an air manifold as discussed in more detail below. As further shown, the pocket door insert preferably includes one more flanges 240 to secure the pocket within a wall opening.

According to a further preferred embodiment, a series of holes may alternatively be formed within the pocket enclosure 200 and may be used along with or in place of any air nozzles/adapters 228. According to this embodiment, the series of holes may preferably direct a flow of air created by the manifold system into the pocket enclosure and/or shower enclosure. According to a further preferred embodiment, the manifold system may provide a flow of air directly into the wall space adjacent to the series of holes so that the increased air pressure in the wall space may drive air through the holes. According to a further preferred embodiment, the number of air holes may be correlated to the amount of horsepower used to supply air to the manifold system. Accordingly, sixty to eighty ⅛ inch holes may be used for every 1 hp of power used to supply air pressure. According to a further preferred embodiment, seventy ⅛ inch holes may preferably be used for every 1 hp of power. Further, the size and count of the air holes may preferably be varied to meet different demands and preferably to maximize the ability of the air to dry the door while minimizing the mechanical sound of the air moving, the electrical motor and the blower.

Figure 3:
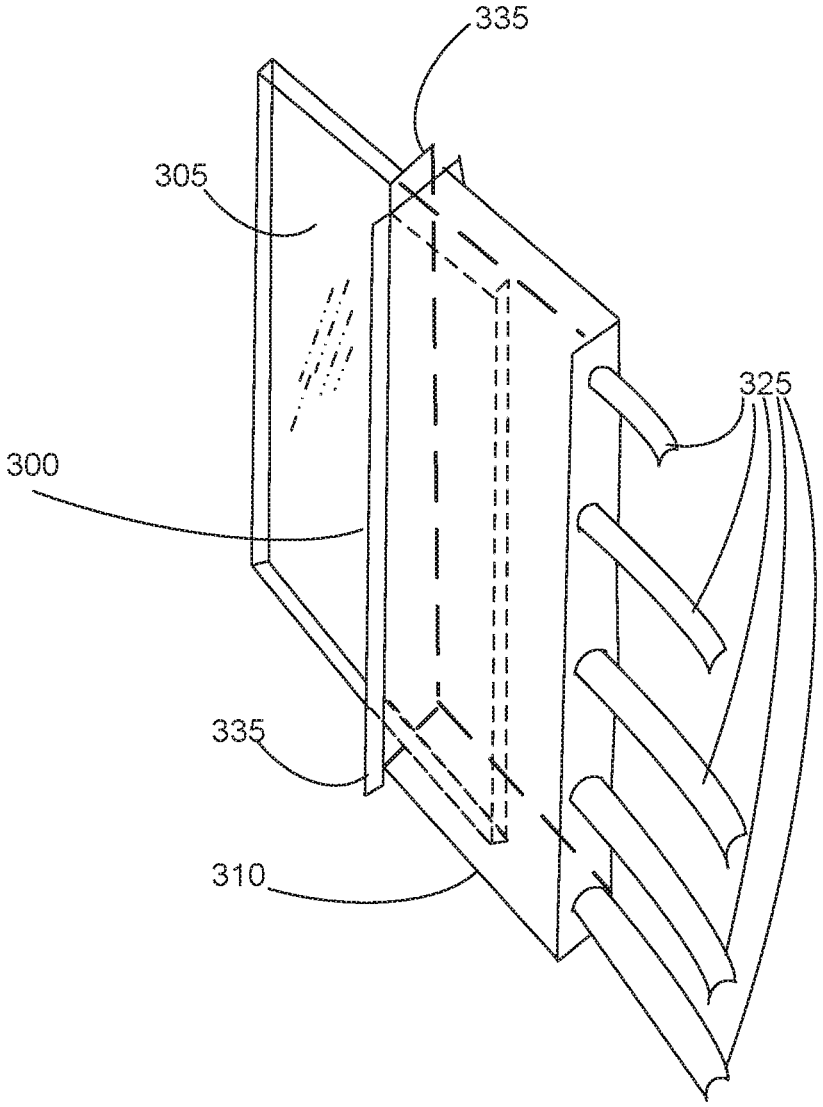
FIG. 3 is a rear perspective view of an exemplary stainless-steel pocket door insert in accordance with a preferred embodiment of the present invention.

With reference now to FIG. 3, a rear perspective view of the present invention will now be further discussed. As shown, the present invention preferably includes one or more air tubes 325 secured to the back of the pocket enclosure 300. Still further, the pocket enclosure 300 preferably further includes a rail (not shown) which secures a pocket door 305 to move within the pocket enclosure 300. Preferably, the pocket enclosure 300 further includes one or more flanges 335 for securing the pocket enclosure 300 within a wall. Preferably, the floor 310 of the pocket enclosure 300 is formed at a pitch to allow for water to drain from within the pocket enclosure 300. Preferably, the pitch allows for drainage but does not interfere with the movement of the pocket door 305 itself.

Figure 4:
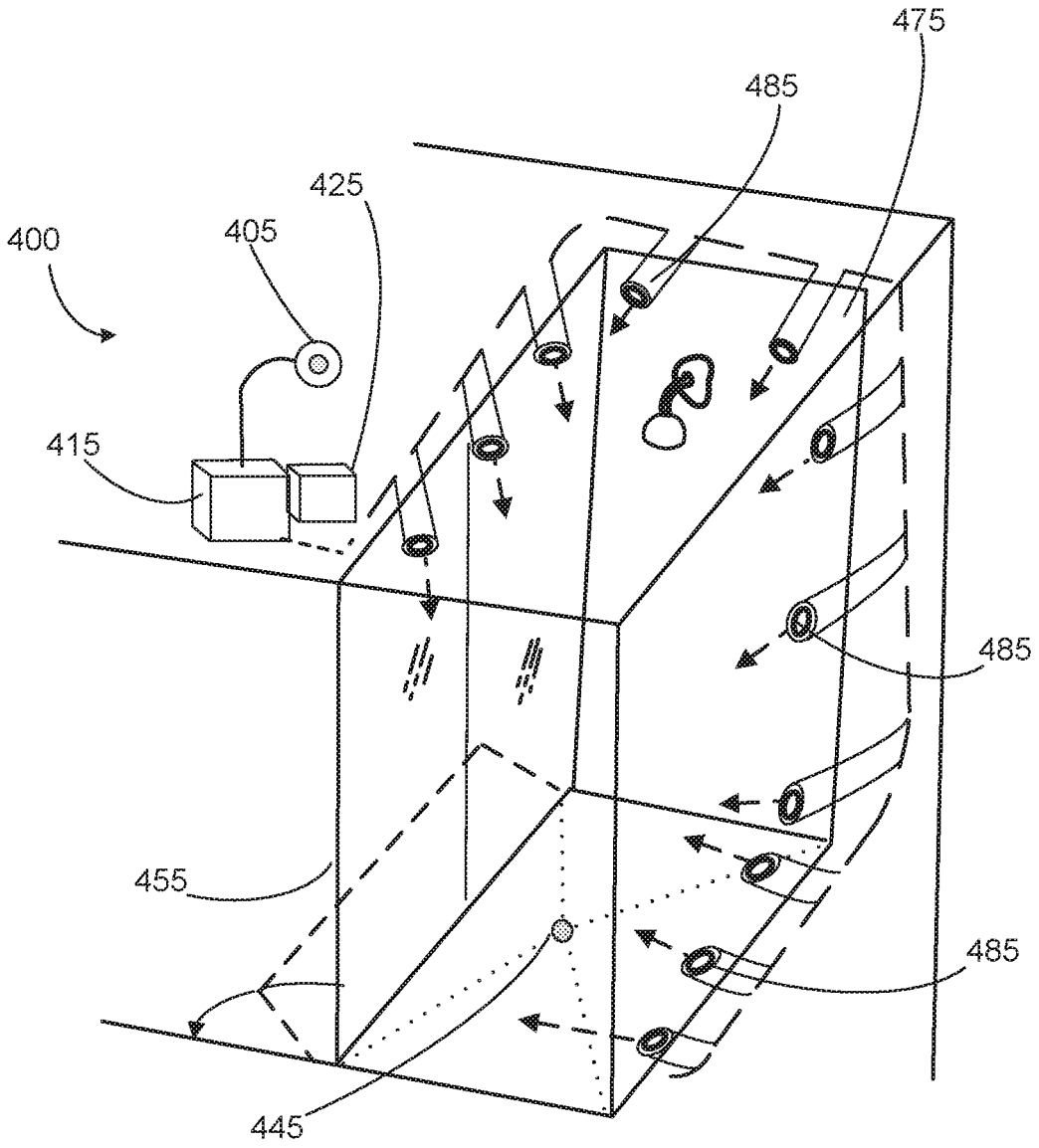
FIG. 4 is a top perspective view of an alternative preferred embodiment of a shower to steam room conversion system of the present invention.

With reference now to FIG. 4, a top perspective view of an alternative preferred embodiment of the present invention will now be discussed. As shown in FIG. 4, the air circulation system of the presentation invention may be retrofitted into the existing walls 455, 475 of an existing shower 400. In the example shown, the alternative embodiment of the present invention is preferably comprised of blower 415 which provides air into the one more air nozzles 485 which are mounted into the existing walls 455, 475 of the shower enclosure. As discussed above, the blower 415 preferably provides air to the air nozzles 485 via one or more plastic tubes (not shown) which are installed to run within the walls of the shower unit. Preferably, the tubing 485 is attached to a manifold system 425 which is attached to the blower 415. According to a preferred embodiment, the manifold 425 may preferably be a 2" PVC barbed manifold and the vinyl tubing may preferably be secured with metal compensating spring clamps. Once connected, the manifold blower system 415, 425 preferably pushes warm air through the tubing to nozzle heads 485 embedded in the shower unit wall. Preferably, the nozzle heads 485 are adjustable and may be directed to blow air that pushes water down the walls into the drain 445. Further, the blower 415 may preferably be located in wall cabinetry or the like and activated by a control button/timer switch 405 which is preferably located convenient to the shower user.

According to further preferred embodiments, the pocket door enclosure discussed with respect to FIGS. 2 and 3 may be used separately or in combination with the shower enclosure embodiment as shown in FIG. 4. Likewise, the shower enclosure embodiment as shown in FIG. 4 may be used by itself without the use of the pocket door enclosure embodiments as shown in FIGS. 2 and 3. When used together, the embodiments may share the same manifold and control system(s) or they may be separately powered and controlled. Further, the system of the present invention may preferably be further adapted for use by incorporating the manifold into many different types of wall constructions and many different types of out-of-the-box shower systems such as one piece showers and tub systems.

Figure 5:
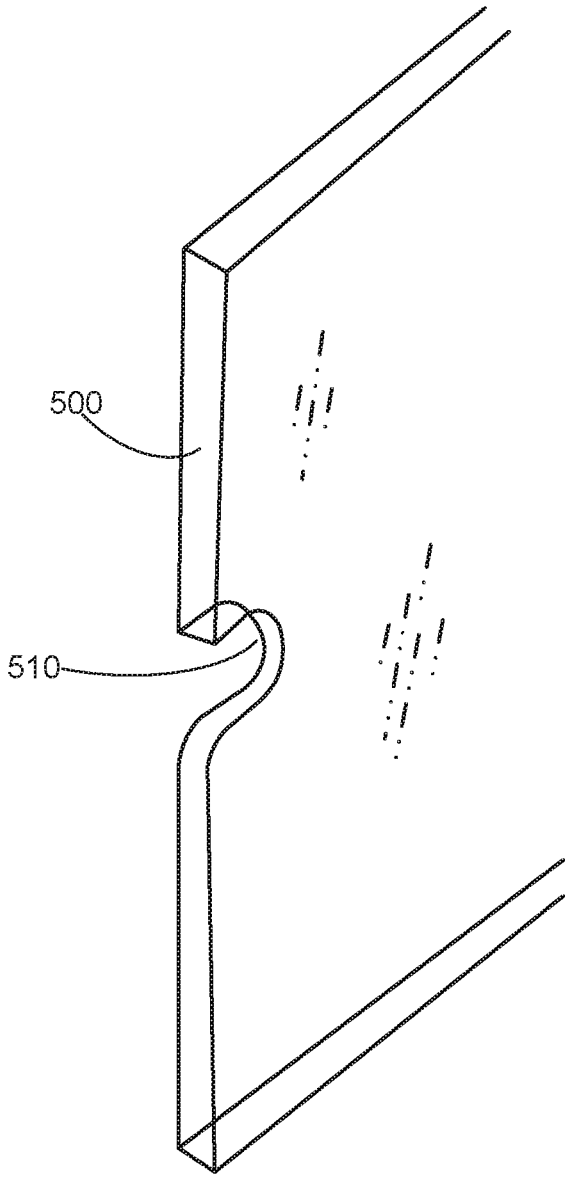
FIG. 5 is a side perspective view of a glass pocket door with a notched pull in accordance with a preferred embodiment of the present invention.

With reference now to FIG. 5, a side perspective view of an exemplary glass door 500 for use with the present invention will now be discussed. As shown in FIG. 5, the exemplary pocket door 500 for sliding into the stainless-steel pocket of the present invention may preferably include a curved notch cut into center, front edge of the door which may serve as a pull 510. In this way, the notched cut 510 in the glass door 500 may act as a door handle so that the door 500 does not require mounted handles.

According to a preferred embodiment of the present invention, the components of the present invention may preferably fit together to form a substantially water and steam proof enclosure which captures the heat and steam produced from a conventional shower. In this configuration, the only escape for the steam is preferably the notched cut 510 in the glass door 500. By using this system, the warmth and moisture from the steam shower may be kept around the shower user for an extended time. Thereafter, once the shower ends, the blower 415 may be activated and the remaining moisture may be dried and/or directed to the drain.

Figure 6:
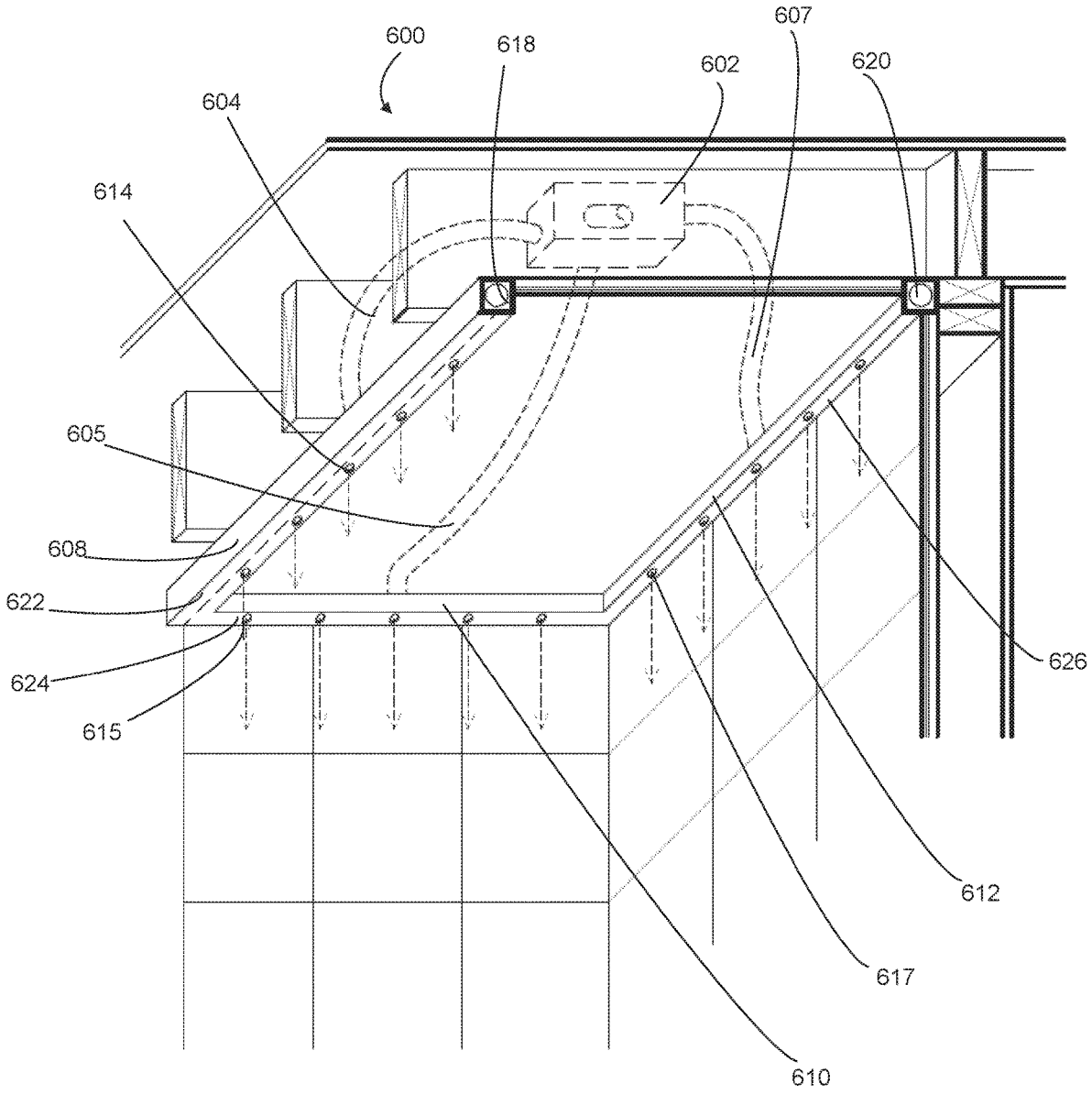
FIG. 6 is a perspective view of an alternative preferred embodiment of the present invention.

With reference now to FIG. 6, a perspective view of an alternative preferred embodiment of the present invention will now be discussed. As shown in FIG. 6, an exemplary air circulation system 600 may include a blower 602 which provides air into the one more air tubes 604, 605, 607 for delivery into respective sidewall tubing assemblies 608, 610, 612. As shown, the sidewall tubing assembly 608, 610, 612 preferably may be fit within wall joints, seams and/or grout lines so that a water-proof front surface faces into shower enclosure. Each tubing assembly 608, 610, 612 preferably includes one more air-jets 614, 615, 617 which provide a directed flow of air down respective shower walls and other surfaces. Further, the tubing assemblies 608, 610, 612 may include front surfaces 622, 624, 626 which enclose the multiple sets of air-jets/directional nozzles 614, 615, 617.

According to a preferred embodiment, the tubing assemblies 608, 610, 612 may include a water-resistance/water-proof protective, outer surface enclosing flexible tubing 618, 620. Preferably, the tubing assemblies 608, 610, 612 may be attached behind shower tiles and positioned so that the nozzles 614, 615, 617 extend between the tiles (i.e. within the mortar or caulking joint) and into the shower enclosure. Additionally, the front surfaces 622, 624, 626 of the tubing assemblies 608, 610, 612 may preferably be formed of grout receptive material. Additionally, the front surfaces 622, 624, 626 may include an abrasive surface to receive and provide additional surface area to allow for grout and/or caulk to adhere to the front surfaces.

Figure 7:
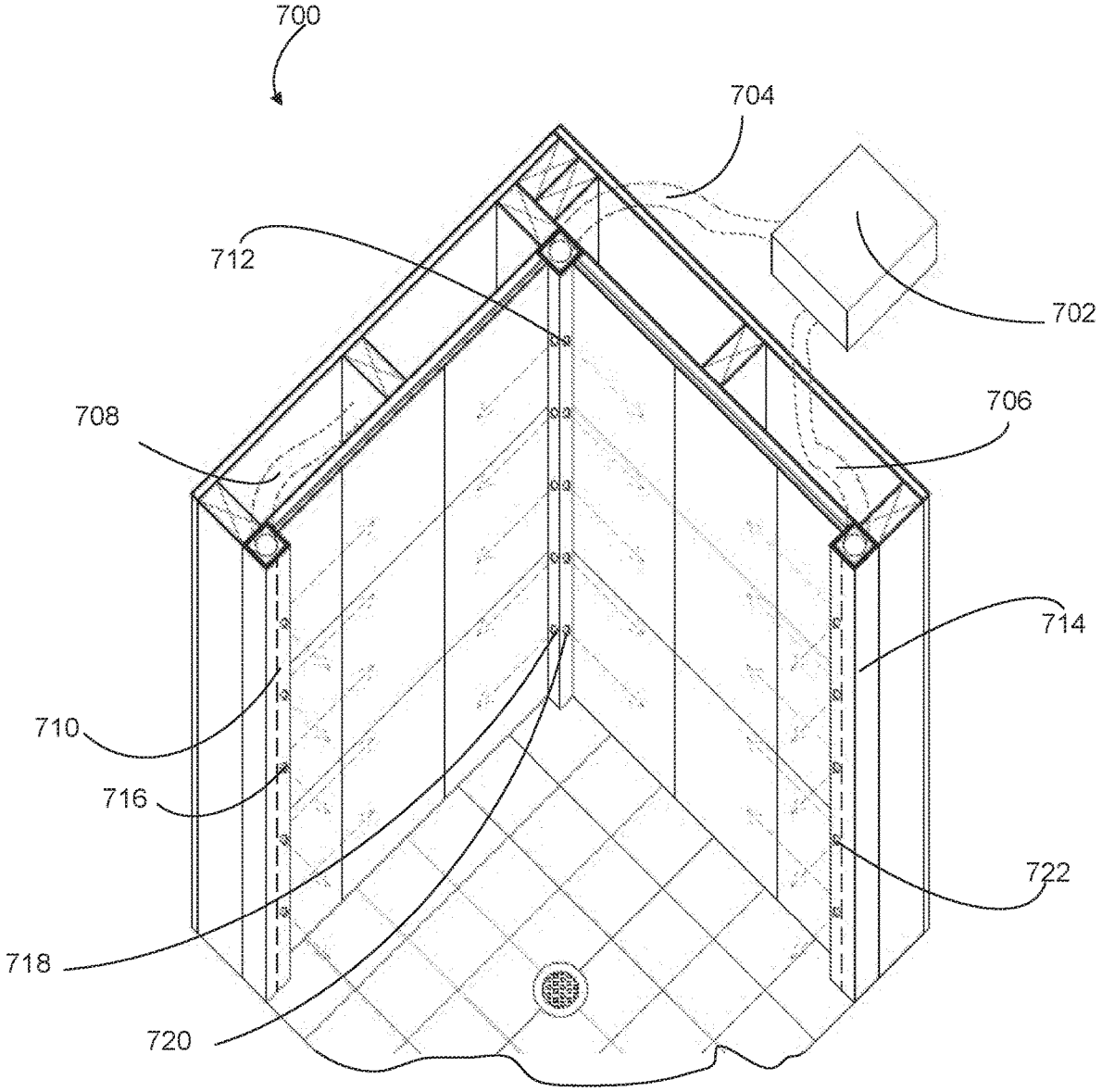
FIG. 7 is a perspective view of a further alternative preferred embodiment of the present invention.

With reference now to FIG. 7, exemplary tubing assemblies 710, 712, 714 may be arranged vertically within a shower enclosure 700. As shown, the tubing assemblies 710, 712, 714 may receive air under pressure from a blower 702 via flexible tubing 704, 706, 708 run within chase walls or similar spaces. As shown, the front surfaces of the tubing assemblies 710, 712, 714 may include air nozzles 716, 718, 720, 722 for directing air onto wall surfaces. As shown, the tubing assemblies 710, 712, 714 may include multiple rows of air nozzles 720, 722 for simultaneously directing air onto multiple wall surfaces.

Figure 8:
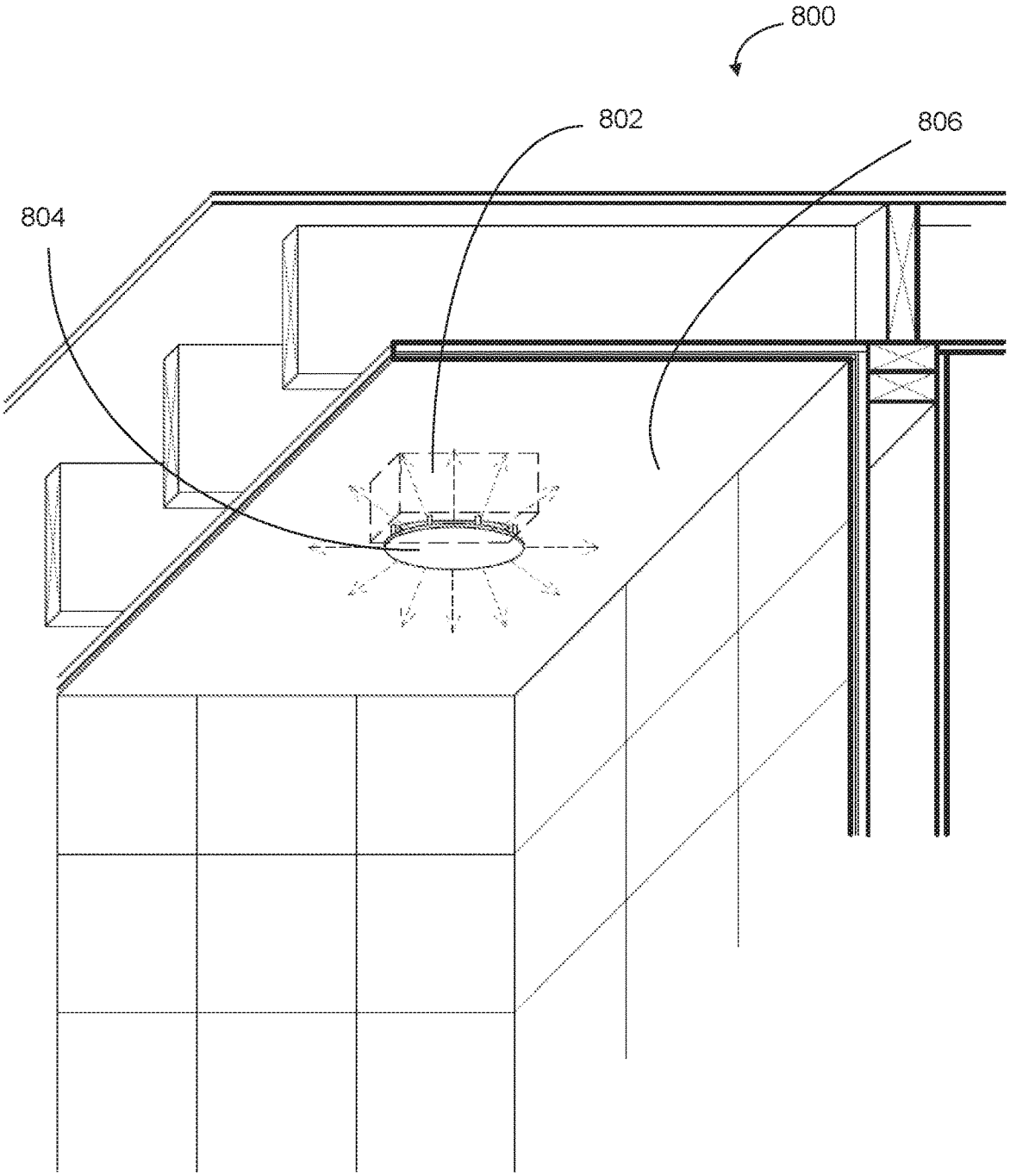
FIG. 8 is a perspective view of a further alternative preferred embodiment of the present invention.

With reference now to FIG. 8, an exemplary system 800 of the present invention may further include an air nozzle 804 which is arranged to be substantially flat against a surface of a shower enclosure. As shown in FIG. 8, the air nozzle 804 is shown attached to a blower 802 and projecting through a roof wall 806. Alternatively, the air nozzle 804 may be attached to the blower 802 via a manifold system (not shown) and may extend through any given surface (i.e. wall, floor, ceiling). Additionally, the air nozzle 804 of the present invention may mechanically or pneumatically move from a retracted, flat position to an extending, open position. Accordingly, the air nozzle 804 may stay retracted until the blower 802 is activated. The air pressure created by the blower 802 may preferably cause the air nozzle 804 to extend and direct air into the shower enclosure. Once the blower 802 is turned off, the air nozzle 804 may preferably again retract.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto. The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. An air circulation system for use with a shower enclosure having a pocket door and a pocket door enclosure, wherein the pocket door enclosure is open to the front and includes a rear wall, a left wall, a right wall, a top wall and a bottom wall; wherein the pocket door is configured to slide along a railing system to move in and out of the pocket door enclosure; further wherein the show enclosure includes walls covered by individual wall protecting surfaces which are separated by grout lines; the air circulation system comprising:

a tubing assembly, wherein the tubing assembly is comprised of flexible tubing; wherein the tubing assembly comprises a front surface; wherein the tubing assembly further comprises a plurality of air nozzles extending from the front surface; wherein the plurality of air nozzles are in fluid communication with the interior of the flexible tubing; wherein the plurality of air nozzles are positioned to direct air down the walls of the shower enclosure;

a blower, wherein the blower is configured to turn on and off; wherein the blower is configured to provide a flow of air when turned on;

a manifold system, wherein the manifold system comprises a plurality of air tubes connecting the blower to the tubing assembly; further wherein the air manifold receives the flow of air from the blower and provides the flow of air to the tubing assembly;

wherein the tubing assembly front surface is configured to attach to a wall of the shower enclosure so that the tubing assembly is secured to the wall and the plurality of air nozzles extend between the individual wall protecting surfaces of the wall; further wherein the air nozzles extend through the grout lines between the individual wall protecting surfaces; and at least one or more air nozzles secured within a wall of the pocket door enclosure.

2. The system of claim 1, wherein the at least one or more air nozzles are located within the rear wall of the pocket door enclosure.

3. The system of claim 1, wherein the pocket door is comprised of rectangular, tempered glass surface with a notched opening.

4. The system of claim 3, wherein the flexible tubing is comprised of one or more tubes which are selected from the group tubes comprising: vinyl, flex, PEX, PVC, polyethylene, copper, galvanized, CPVC, plastic and polypropylene.

5. The system of claim 4, wherein the at least one or more air nozzles are configured to direct air in a first direction and a second direction.

6. An air circulation system for use with a shower enclosure having a pocket door and a pocket door enclosure, wherein the pocket door enclosure is open to the front and includes a rear wall, a left wall, a right wall, a top wall and a bottom wall; wherein the pocket door is configured to slide along a railing system to move in and out of the pocket door enclosure; further wherein the shower enclosure includes walls covered by individual wall protecting surfaces; the air circulation system comprising:

a tubing assembly, wherein the tubing assembly is comprised of flexible tubing; wherein the tubing assembly comprises an air nozzle attached to the flexible tubing; wherein the tubing assembly further comprises an air nozzle assembly; wherein the air nozzle is in fluid communication with the interior of the flexible tubing; wherein the air nozzle is positioned to direct air down the walls of the shower enclosure;

a blower, wherein the blower is configured to turn on and off; wherein the blower is configured to provide a flow of air when turned on;

a manifold system, wherein the manifold system comprises a plurality of air tubes connecting the blower to the tubing assembly; further wherein the manifold system receives the flow of air from the blower and provides the flow of air to the tubing assembly;

wherein the air nozzle is configured to retract within the air nozzle assembly when the blower is off; wherein the air nozzle is configured to extend from the air nozzle assembly when the blower is on; and at least one or more air nozzles secured within a wall of the pocket door enclosure.

7. The system of claim 6, wherein the at least one or more air nozzles are located within the rear wall of the pocket door enclosure.

8. The system of claim 7, wherein the pocket door is comprised of rectangular, tempered glass surface with a notched opening.

9. The system of claim 8, wherein the flexible tubing is comprised of one or more tubes which are selected from the group tubes comprising: vinyl, flex, PEX, PVC, polyethylene, copper, galvanized, CPVC, plastic and polypropylene.

* * * * *